United States Patent [19]

Budmiger

[11] 4,262,908

[45] Apr. 21, 1981

[54] LIGHT RAY TARGET APPARATUS

[75] Inventor: Hermann Budmiger, Seewen, Switzerland

[73] Assignee: Laspo AG, Diessenhofen, Switzerland

[21] Appl. No.: 86,170

[22] Filed: Oct. 18, 1979

[51] Int. Cl.[3] ..... F41J 5/02

[52] U.S. Cl. ..... 273/310; 273/312

[58] Field of Search ..... 273/310, 311, 312

[56] References Cited

U.S. PATENT DOCUMENTS

| | | | |
|---|---|---|---|
| 2,934,634 | 4/1960 | Hellberg | 273/310 X |
| 3,956,627 | 5/1976 | Kikuchi et al. | 273/310 X |

FOREIGN PATENT DOCUMENTS

| | | | |
|---|---|---|---|
| 643852 | 4/1937 | Fed. Rep. of Germany | 273/310 |

*Primary Examiner*—Anton O. Oechsle
*Attorney, Agent, or Firm*—Werner W. Kleeman

[57] ABSTRACT

A target apparatus for simulating firing with a weapon which emits firing or shooting pulses. A first device serves for detecting target rings which have been hit and a second device serves for detecting target sectors which have been hit. These detection devices are mutually interconnected by an evaluation device and with a hit-indicator device. The first detection device scans the target for firing pulses by means of a revolving receiver. The revolving receiver comprises receiving elements, arranged along a radial way of the target, for the target rings. The second detection device detects the position of the revolving receiver, i.e., the sector when hit by a firing pulse.

30 Claims, 13 Drawing Figures

Fig. 6
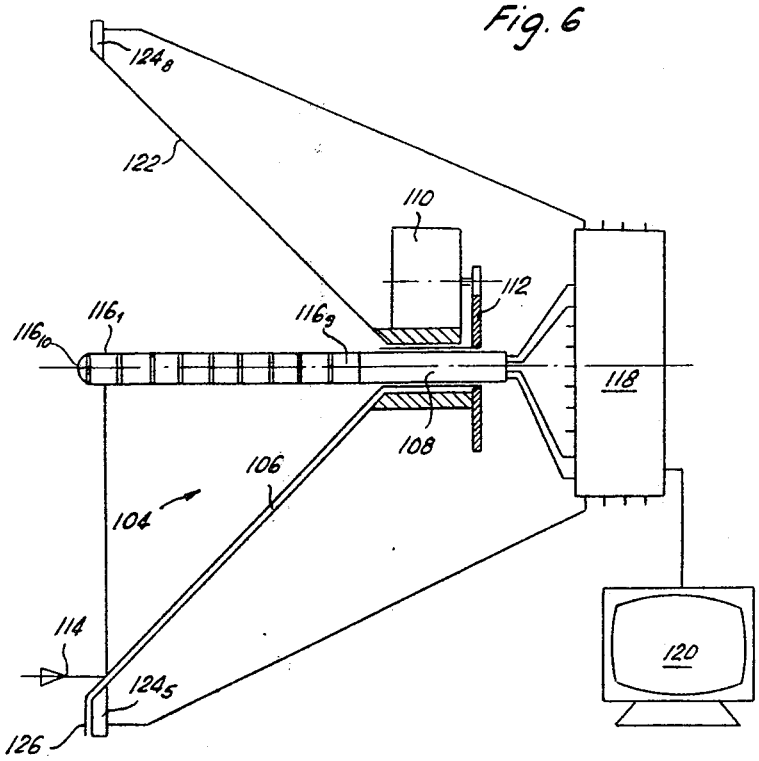
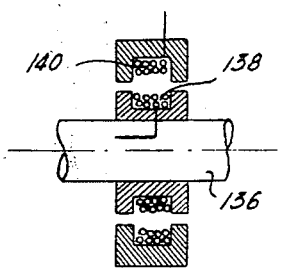
Fig. 9

LIGHT RAY TARGET APPARATUS

CROSS-REFERENCE TO RELATED CASE

This application is related to my commonly assigned, copending U.S. application Ser. No. 859,723, filed Dec. 12, 1977, now U.S. Pat. No. 4,195,422, granted Apr. 1, 1980 entitled "System For Simulating Weapon Firing".

BACKGROUND OF THE INVENTION

The present invention relates to a new and improved construction of target apparatus useful as a weapon training system, and, more specifically, pertains to a novel construction of target apparatus for simulating firing of a weapon.

Generally speaking, the inventive target apparatus serves for the simulated firing with a weapon which emits firing or shooting pulses and is of the type comprising a first device for detecting target rings which have been hit and a second device for detecting target sectors which have been hit. These detector or detection devices are mutually interconnected by an evaluation device and with a hit-indicator device.

A target apparatus of the previously mentioned type is known to the art, for instance from German Patent Publication No. 2,756,210. With this target apparatus the target is divided into target rings and target sectors. Photo-transistors are employed as the receiving elements for shooting pulses. The collectors of the photo-transistors are formed as target rings and the emitters of such photo-transistors are formed as target sectors. A large number of receiving elements is required for covering the entire target image.

SUMMARY OF THE INVENTION

Therefore, with the foregoing in mind it is a primary object of the present invention to provide a new and improved construction of target apparatus which is simpler and less complicated in design than the heretofore discussed prior art construction.

Another and more specific object of the present invention aims at the provision of a new and improved target apparatus of the previously mentioned type which is constructed such that there is required a lesser number of receiving elements, while nonetheless obtaining an exact evaluation of the target image.

Still a further significant object of the present invention is to provide a target apparatus which is relatively simple in construction and design, economical to manufacture, extremely reliable in operation, and affords good weapon firing simulation characteristics with high hit accuracy.

Now in order to implement these and still further objects of the invention, which will become more readily apparent as the description proceeds, the target apparatus of the present development is manifested by the features that the first detection device scans the target for firing pulses in a revolving radial zone by means of at least one revolving receiver containing receiving elements for the target rings, and the second detection device detects the position of the revolving receiver when hit by a firing pulse.

The terms "transmitter" and "receiver", as used herein, are to be understood as being employed in their broadest sense and are meant to embody all possibilities of contactless influencing of one element by the other and of emitting a signal.

Since the receiver is structured to be of a revolving type, there is only required one receiving element, capable of scanning the entire target ring circumference, for a target ring. In the simplest case, therefore, there are only required the same number of receiving elements as there are target rings on the target. Hence, a substantial saving of receiving elements is realized in comparison with heretofore known target apparatus.

If desired, the target apparatus can be equipped with two receivers, each of which comprise receiving elements for the target rings, and which are preferably arranged diametrically with respect to the target axis, each scanning one half of the target. Hence, there is then beneficially realized a reduction in the scanning time or the rotational speed of the revolving receivers can be reduced. Advantageously, however, there is provided only one revolving receiver containing receiving elements. The period of revolution of the receiver must then at most correspond to the firing pulse duration, since otherwise there cannot be detected the entire target circumference or area.

As a rule, it is sufficient to provide one receiving element for each target ring. If necessary, however, it is possible to also employ two or more receiving elements for each target ring. With this construction the accuracy of the indication of hits can be improved.

According to a beneficial construction of the invention the receiver possesses a mirror strip inclined at an angle of about 45° to the target axis and rotates about the latter in order to deflect firing pulses onto the receiving elements arranged along the target axis. This constitutes a particularly simple design of the target apparatus, since the receiving elements are in a stationary arrangement and only the mirror strip rotates. Hence, there do not arise any difficulties in the transmission of the signals to the evaluation device. However, the receiving elements must be constructed such that they can receive firing pulses over the entire area or circumference.

A further aspect of the invention contemplates locating the receiving elements on a rotary, preferably disk-shaped, revolving element. A signal transmitter, preferably of the contactless type, is arranged between the revolving element and a stationary element. With this arrangement it is possible to use simple receiving elements which need only have a punctiform range of action. However, difficulties arise in transmitting the signals of the receiving elements from the revolving element to stationary elements. To counteract this difficulty it is advantageous if the revolving element comprises a coding device for the signals to be transmitted. With this construction there is not required a transmitter device for each receiving element, rather the signals of several receiving elements can be combined and transmitted by means of a smaller number of transmitting devices.

Another refinement of the invention contemplates that the revolving element comprises a memory or storage for the signals to be transmitted, this memory being cleared at the end of a revolution. This design is advantageous since it renders possible carrying out transmission of the signals only at one point of the path of revolution, with the result that there is realized a simpler design of the transmitting or transmitter device. In this case it is advantageous to use a transmitter or transmitter device which comprises at least one transmitter or emitter located on the revolving element and at least one receiver located on the stationary element.

There is also possible a continuous transmission of the signals, with the result that the complexity of the apparatus can be reduced. Continuous transmission can be accomplished by means of revolving collectors. The transmission can be improved by using several parallel collectors. A particularly good design is realized when the transmitter device comprises at least one contact disk which rotates with the revolving element and which immerses into a stationary bath of a conductive liquid, preferably mercury.

Signal transmission without contact is particularly advantageous and can be realized, for instance, through a construction of transmitter device which comprises at least one coaxially arranged induction coil which rotates with the revolving element and which interacts with a coaxially arranged, stationary induction coil. Particularly advantageous, however, is a construction wherein the transmitter device comprises at least one capacitor plate located on and co-rotating with the revolving element and which is associated with a stationary capacitor plate. With this arrangement there is afforded an effective fault-free signal transmission with very simple means.

According to a further aspect of the invention the second detection device comprises a number of transmitters arranged at the revolving element and corresponding in number to the number of target sectors to be detected. The second detection device further comprises a stationary receiver which is operatively connected with a counter, preferably a shift register, which can be extinguished at the end of each revolution of the revolving element, counting of the counter being interrupted by a ring signal. This construction of second detection device enables providing a large number of target sectors which are to be detected. The transmitters for transmitting the sector signals can be of different designs. Thus, the transmitters can be, for instance, permanent magnets which are scanned by an induction coil as receiver. A particularly simple design is realized if there are utilized as the transmitters light-colored lines which stand out against a dark background, and thus, reflect light which can be detected by a phototransistor used as a particularly simple type of receiver. An especially simple construction of second detector device, rendering it possible to directly allocate the particular sector to the ring which has been hit, can be realized if such second detector device comprises a transmitter arranged at the revolving element and which successively interacts with a number of stationary receivers corresponding to the number and position of the target sectors to be detected. Here, there is particularly simple and effective a construction wherein a capacitor plate is arranged at the revolving element and corresponds to the size of the target sector to be covered. This capacitor plate cooperates in succession with a number of stationary capacitor plates, the number of which corresponds to the number and position of the target sectors to be detected.

Collector rings can be used for supplying current to the receiving elements. An inductive supply of current is also possible, analogous to the aforementioned design of the transmitter device incorporating at least one coaxially arranged induction coil co-rotating with the revolving element and interacting with a coaxially arranged, stationary induction coil.

A particularly beneficial embodiment of the target apparatus contemplates constructing the detection devices such that each comprise receivers having light-conductors which, on the one hand, terminate along a radial ray in the target plane of a revolving element, and, on the other hand, lead to transmitter devices between the rotary revolving element and a stationary part on which there are located receiving elements. The light-conductors render it possible to detect a light signal, given by a firing or shooting pulse, and to further transmit the same in a simple manner. In this case the effect of extraneous light is particularly small. It can be further reduced if there is provided an interference filter, for eliminating the influence of extraneous light, which is located at the ends of the light-conductors, preferably in the plane of the target image. The transmission of the light signal by means of the light-conductors via the transmitter devices to a stationary part is accomplished simply and, in particular, without any electrical transmission means which could give rise to faults. It is of advantage in this regard if the target apparatus is designed such that pairs of light-conductors of the first and second detection devices end in each case along a radial ray in the target plane of the revolving element. In this way there is insured for the detection of both the rings and the sectors of the target.

A preferred design of the first detection device, contemplates that the light-conductors thereof each end at the transmitter devices radially on the circumference of a shaft of the revolving element, in a reflecting, preferably chromium-plated, annular space which is monitored by a stationary receiving element, preferably having arranged forwardly thereof a collecting lens. The annular space can be formed by a groove in a bore of a bearing or a bush of the stationary part. However, this annular groove is preferably constructed such that it is provided in the shaft and, preferably, has a groove base or bottom of arcuate cross-section. The groove base of arcuate cross-section insures that, the light signal will be reliably further transmitted due to further bundling during the reflection in the annular space. To cover or detect the sector of a hit it is advantageous to construct the target apparatus such that the light-conductors of the second detection device are combined at the transmitter device to produce a bundle which coacts successively with stationary receiving elements arranged along a circle, preferably having a collecting lens placed forwardly thereof. It is possible to beneficially enlarge the range of coverage or detection, which is small due to the small cross-section of a light-conductor, if, according to a further aspect of the invention, a collecting lens is provided at the end of each of the light-conductors in the target plane of the revolving element.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 6 illustrates a further target apparatus in vertical section and cut-out view;

FIG. 9 illustrates a transmitter device arranged on the shaft of a revolving element, the showing being in vertical sectional and cut-out view;

DETAILED DESCRIPTION OF THE PREFERRED EMBODIMENTS

Figure 1:
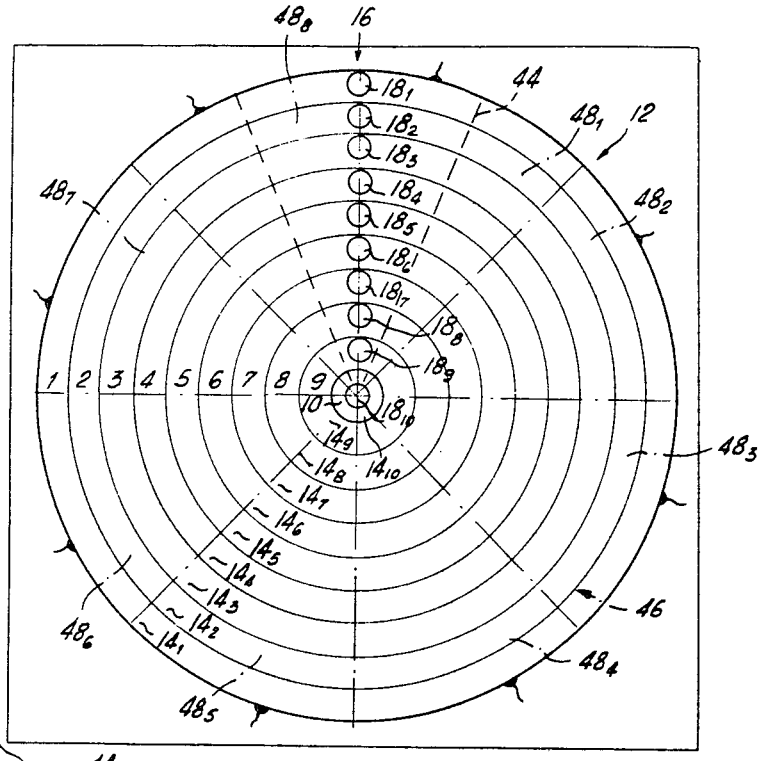
FIG. 1 illustrates a target apparatus as a front view of the target.
Figure 2:
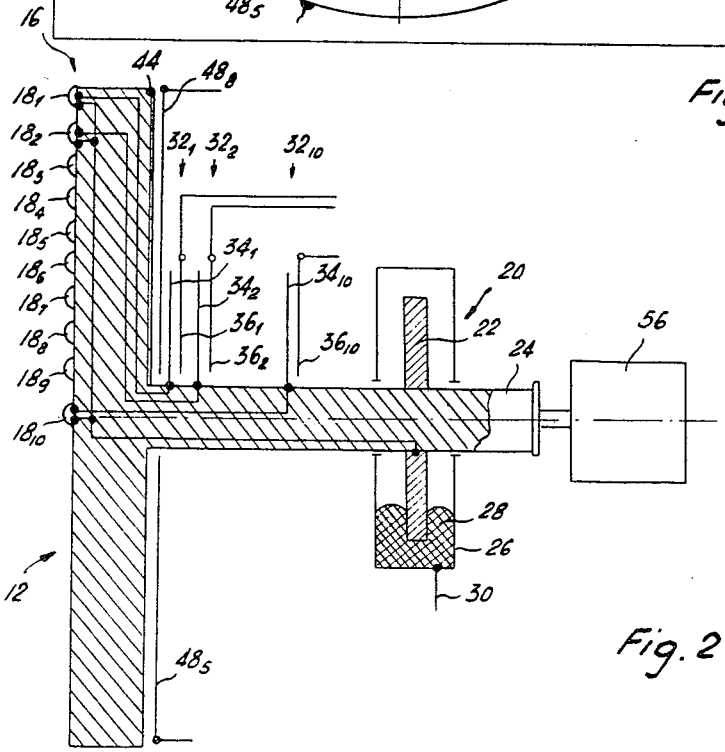
FIG. 2 illustrates the target apparatus of FIG. 1 in vertical sectional and cut-out view.
Figure 3:
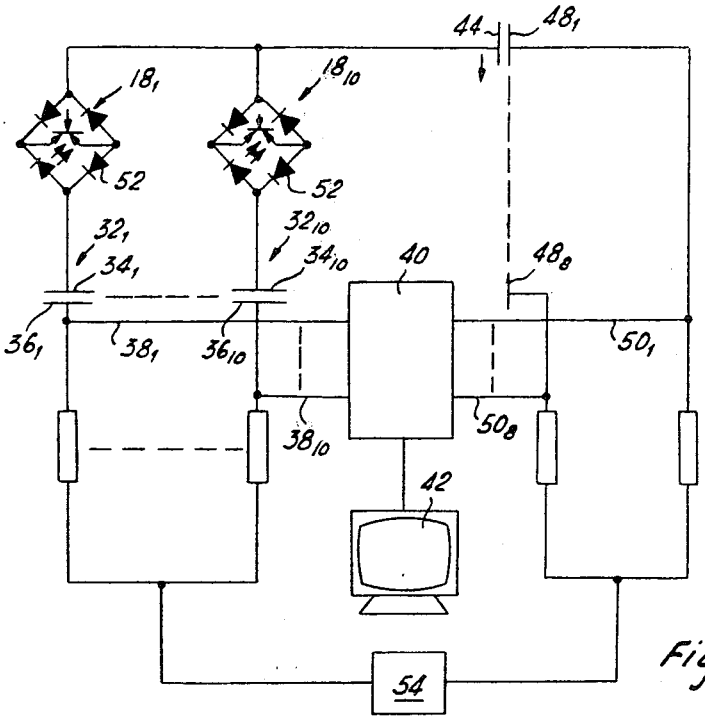
FIG. 3 is a circuit diagram of the target apparatus of FIG. 1.

Describing now the drawings, FIGS. 1 to 3 illustrate a first exemplary embodiment of target apparatus for simulated firing with a weapon which emits firing or shooting pulses. This target apparatus will be seen to comprise a substantially disk-shaped revolving element 12 which contains printed thereon the target rings $14_1$ to $14_{10}$. The revolving element 12 further comprises a receiver 16 for the firing or shooting pulses. This receiver 16 comprises individual receiving elements 18, for example photo-transistors, arranged along a radial ray. Each target ring $14_1$ to $14_{10}$ has operatively associated therewith a receiving or receiver element $18_1$ to $18_{10}$, respectively. The receiver 16 constitutes a first detection device for target rings which have been hit. The receiving elements $18_1$ to $18_{10}$ are supplied with current by means of a transmitter device 20 which has a contact disk 22 which is rigidly connected to a shaft 24 of the revolving element 12 and immerses into a stationary bath 26 which contains a conductive liquid 28, preferably mercury. A lead or infeed line 30 ends in the bath 26. Furthermore, the receiving elements $18_1$ to $18_{10}$ are connected to transmitter devices $32_1$ to $32_{10}$ composed of capacitor plates $34_1$ to $34_{10}$, connected with the shaft 24, and coacting with the stationary capacitor plates $36_1$ to $36_{10}$, respectively. The transmitter devices $32_1$ to $32_{10}$ are connected to an evaluation or evaluating device 40 with which there is connected, in turn, a hit-indicator device 42 constructed for instance in the form of a display screen.

The target apparatus comprises a second detection device which detects the position of the revolving receiver 16 when struck by a firing or shooting pulse. This second detection device comprises a capacitor plate 44 located at the rear of the revolving element 12 and revolving in conjunction with such revolving element 12. The size of the capacitor plate 44 corresponds to a target sector 46 which is to be covered or detected. In the embodiment under discussion, the target is subdivided into eight target sectors each encompassing an angle of 45°. This revolving capacitor plate 44 coacts with the stationary capacitor plates $48_1$ to $48_8$, the size and position of which correspond to the actual target sectors 46. The stationary capacitor plates $48_1$ to $48_8$ are likewise connected to the evaluation device 40.

Turning attention now the circuit diagram of FIG. 3 there is shown the construction of the receiving elements $18_1$ to $18_{10}$ as photo-transistors arranged in bridge circuits with diodes 52 and which, when hit by a shooting pulse, become conductive, and thus, establish the current connections in the circuit. The receiving elements $18_1$ to $18_{10}$ are each connected in series with the transmitter elements $32_1$ to $32_{10}$ composed of the rotary capacitor plates $34_1$ to $34_{10}$ and the stationary capacitor plates $36_1$ to $36_{10}$. The individual members, consisting of the receiving elements and transmitter devices, are mutually connected in parallel and commonly in series with the second detection device for the target sectors. A high-frequency generator 54, for instance a quartz oscillator, drives the circuit. The stationary capacitor plates $36_1$ to $36_{10}$ of the transmitter device for the target ring signals and the stationary capacitor plates $48_1$ to $48_8$ of the transmitter device for the target sector signals are respectively connected by means of the output leads or lines $38_1$ to $38_{10}$ and the output leads or lines $50_1$ to $50_8$ with the evaluation device 40 which, in turn, is connected with the hit-indicator device 42.

A drive motor 56 connected with the shaft 24 drives the revolving element 12. The speed of rotation is here assumed to amount to, for instance, 3000 to 4000 revolutions per minute. This corresponds to a period of revolution of the revolving element 12 from 0.02 to 0.015 seconds for each revolution. The duration of a firing pulse is, for example, 0.005 to 0.020 seconds, so that the period of revolution of the revolving element 12, and thus, that of the receiver 16 is equal to or smaller than the duration of the firing pulse.

Figure 4:
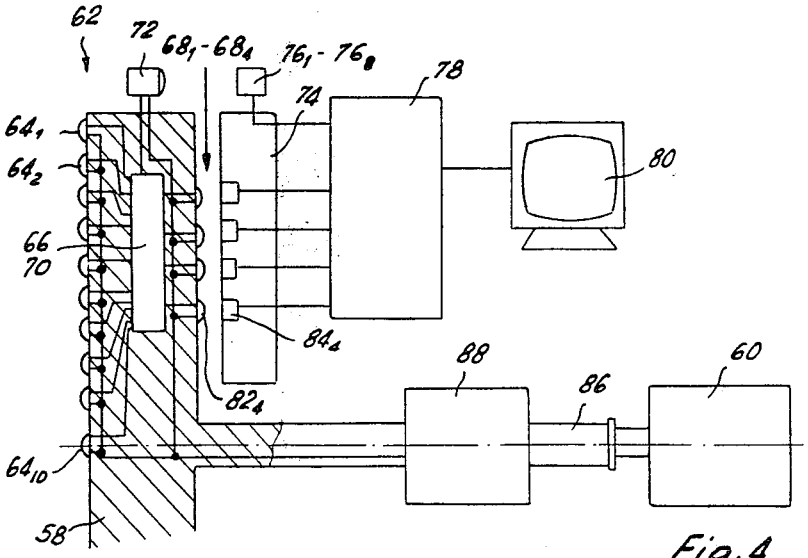
FIG. 4 illustrates a further construction of target apparatus in vertical section and cut-out view.
Figure 5:
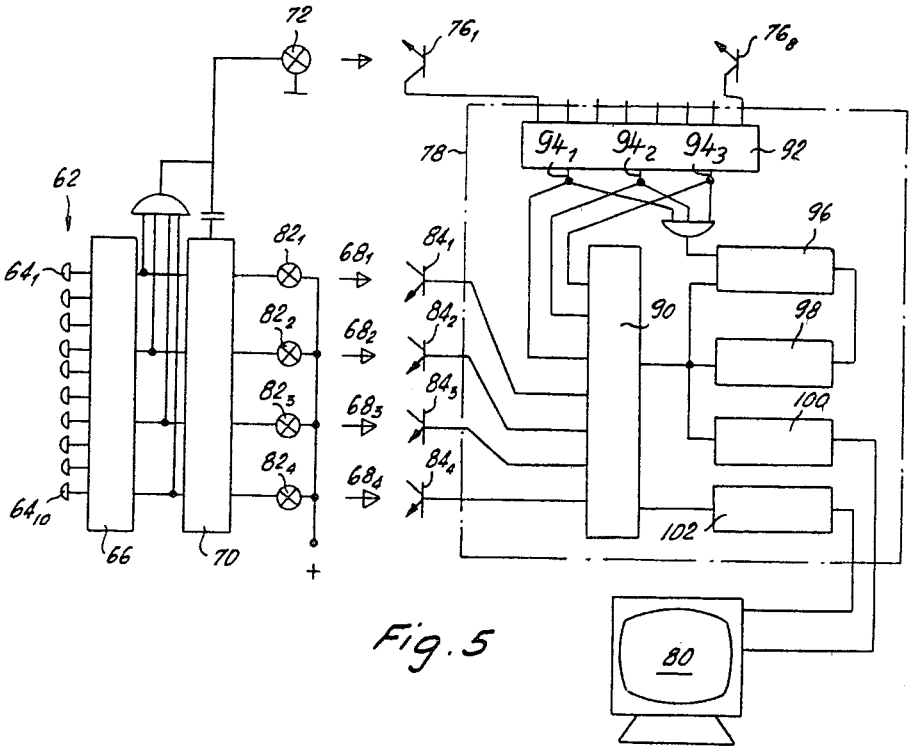
FIG. 5 is a circuit diagram of the target apparatus of FIG. 4.

FIGS. 4 and 5 illustrate a further target apparatus possessing a substantially disk-shaped revolving element 58 driven by a drive motor 60. The revolving element 58 contains a receiver 62 for shooting or firing pulses which, again, analogous to the illustrative embodiment described above, is provided with receiving elements $64_1$ to $64_{10}$ arranged along a radial ray. The receiving elements $64_1$ to $64_{10}$ are connected with a coding device 66 which encodes the signals from the receiving elements $64_1$ to $64_{10}$, so that only four transmitter devices $68_1$ to $68_4$ are required for transmitting the signals. Moreover, the revolving element 58 contains a memory or storage 70 which retains the signals to be transmitted until they can be transmitted, after which they are again cleared.

In addition to the above-mentioned first detection device for target rings which have been hit, the revolving element 58 also contains a transmitter or emitter 72 which is connected to each receiving element $64_1$ to $64_{10}$ and emits beams or rays, for instance light beams, as soon as a receiving element has been hit by a firing pulse. A number of receivers 76, corresponding to the number of target sectors to be covered or detected, is arranged on a stationary element 74 of the target apparatus, in order to detect the rays emitted by the transmitter or emitter 72 and to pass them on to an evaluating device 78 which, in turn, is connected with a hit-indicator device 80 having the form of a display screen.

The transmitter devices $68_1$ to $68_4$ for the encoded target ring signals each comprise a transmitter or emitter $82_1$ to $82_4$, coacting with receivers $84_1$ to $84_4$, respectively, arranged on the stationary element 74. Since the receivers $84_1$ to $84_4$ are only located at one point and not along the entire path of revolution, transmission of the target ring signals can only occur at one defined point when the transmitters or emitters $82_1$ to $82_4$ are aligned with the receivers $84_1$ to $84_4$, respectively. The memory or storage 70 insures that the signals generated by the shooting pulses are preserved until the time of transmission of the signals. Then the signals are cleared from the memory 70. In order to power the components located on the revolving element 58 there is employed a dynamo 88 located on the shaft 86 of the revolving element 58, so that there can be dispensed with the use of transmission elements for the current supply which otherwise constitute a potential source of faults.

As can be particularly well seen by referring to FIG. 5, the evaluation device 78 can advantageously comprise a shift register 90 with which there are connected the receivers $84_1$ to $84_4$ of the transmitter devices $68_1$ to $68_4$. Moreover, the evaluation device 78 contains a coding device 92 with which there are connected the receivers $76_1$ to $76_8$ of the second detection device for the target sector signals. The outputs $94_1$ to $94_3$ are connected, on the one hand, with the shift register 90 and, on the other hand, with a counter 96. This counter 96 is coupled, in turn, with a clock generator 98 which, on the one hand, triggers the shift register 90 and, on the other hand, is connected with a multivibrator 100 which is connected with the hit-indicator device or instrument 80. The shift register 90 is connected with a second multivibrator 102 which, in turn, is connected with the hit-indicator device 80.

FIG. 6 illustrates a further target apparatus which comprises a receiver 104 containing a revolving mirror strip 106. This revolving mirror strip 106 is inclined at an angle of about 45° with respect to the target axis 108 and is placed into rotation by a drive motor 110 and toothed gearing 112 or equivalent structure. The mirror strip 106 serves for the deflection of incoming firing or shooting pulses 114 towards receiving elements $116_1$ to $116_9$ arranged along the target axis 108. The receiving element $116_{10}$ for the ring of tens of the target is located on the end face of the target axis 108 and is directly impinged. The receiving elements are connected with an evaluation device 118 which is connected with a hit-indicator device or instrument 120.

In addition to the above-described first transmitter device for target ring signals, the target apparatus further comprises a second detection device for target sector signals. The latter contains receivers $124_1$ to $124_8$ located on a stationary funnel-shaped screen 122 and which are impinged by means of a transmitter or emitter 126 located on the revolving mirror strip 106. This transmitter or emitter 126 can consist of, for instance, a strip of sheet metal which activates receivers 124, for instance in the form of proximity initiators. The receivers $124_1$ to $124_8$ are likewise connected with the evaluation device 118.

Figure 7:
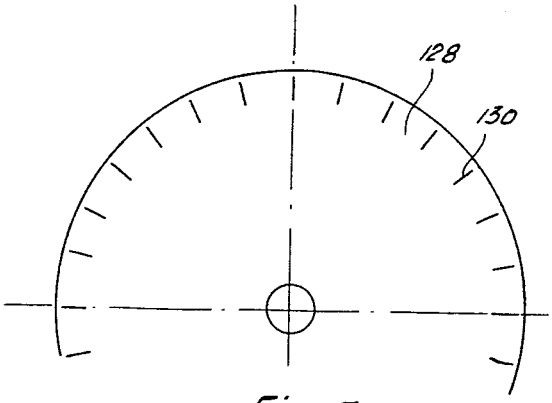
FIG. 7 illustrates a second detection apparatus in top plan view of the revolving element.
Figure 8:
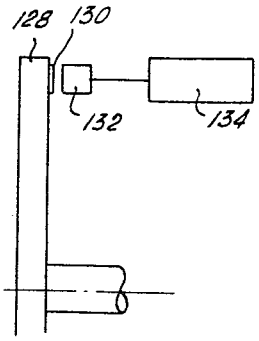
FIG. 8 illustrates the second detection apparatus of the arrangement of FIG. 7 in vertical sectional view.
Figure 10:
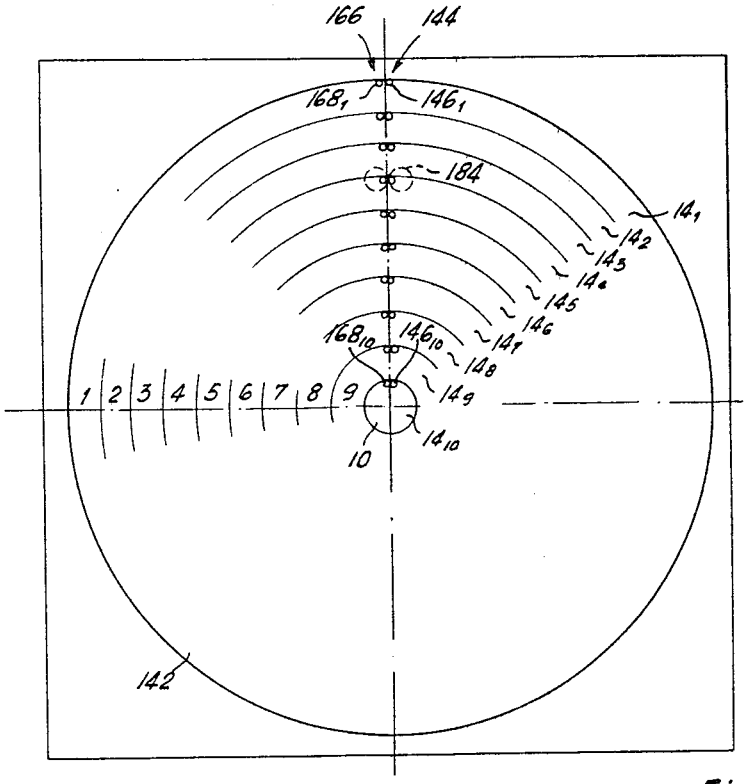
FIG. 10 illustrates a target apparatus containing receivers in the form of light-conductors and as a front view of the target.
Figure 11:
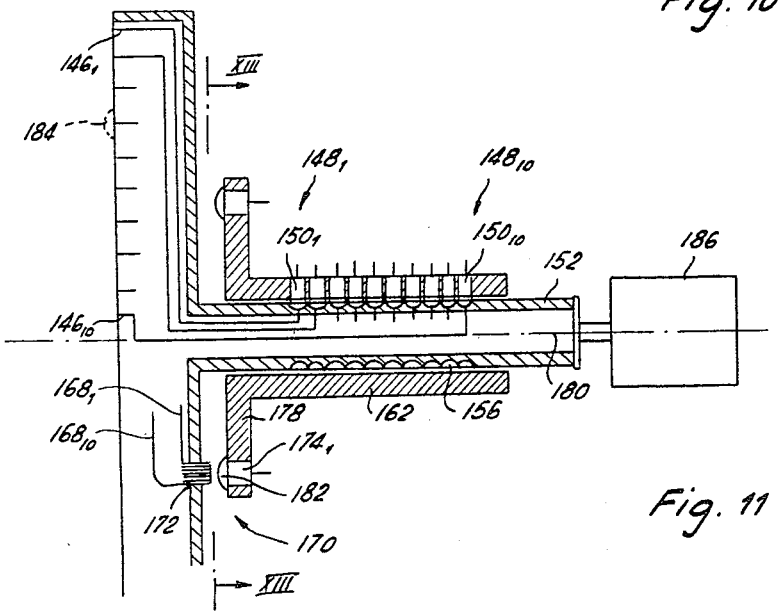
FIG. 11 illustrates the target apparatus of FIG. 10 in vertical section and cut-out view.
Figure 12:
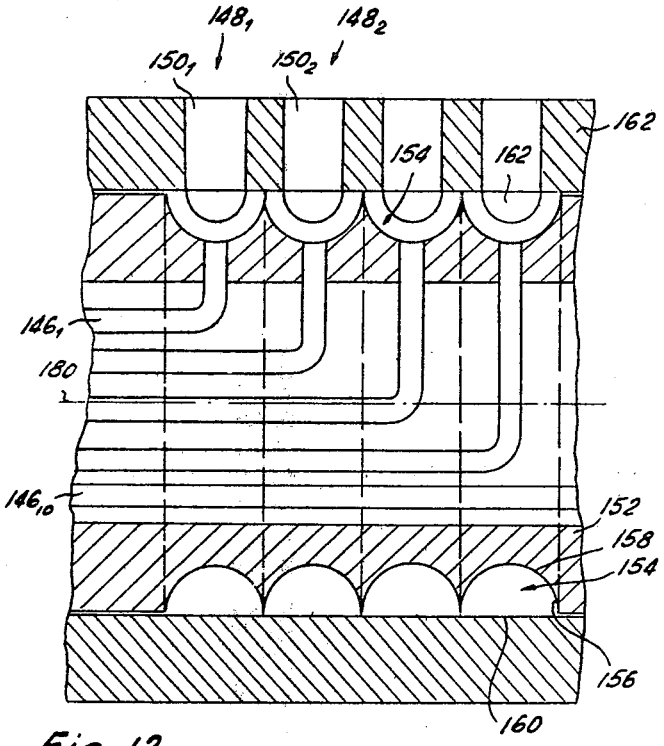
FIG. 12 illustrates the transmitter device of the first detection device in vertical section and on an enlarged scale.
Figure 13:
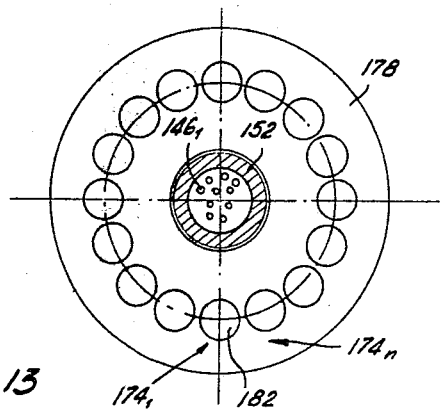
FIG. 13 is a sectional view of the target apparatus of FIG. 11, taken substantially along the line XIII—XIII thereof.

FIGS. 7 and 8 portray a further exemplary embodiment of a second detection device for target sector signals. This second detection device also is provided with a revolving element 128 which is of substantially disk-shaped construction and has a number of transmitters or emitters 130 for sector signals, corresponding to the number of target sectors to be covered or detected. These transmitters or emitters 130 coact with a stationary receiver 132 connected with a counter 134 which is reset at the end of each revolution of the revolving element 128. The counter 134 is constituted, for instance, by a shift register. The counting operation of the counter 134 is interrupted when a target ring signal acts upon the counter 134. The transmitters or emitters 130 are for instance in the form of light-colored lines arranged on a dark background of the revolving element 128 and can be registered by the receiver 132 which is constructed as a photo-transistor.

FIG. 9 illustrates a construction of contactless transmitter device which can be employed both for supplying current and for transmitting signals. This transmitter device will be seen to contain an induction coil 138 coaxially arranged on the shaft 136 of the revolving element and co-rotates with such shaft 136. Above the induction coil 138 there is coaxially arranged a second stationary induction coil 140. The stationary induction coil 140 serves as the primary winding and is powered, for instance, by high-frequency current. The induction coil 138 arranged upon the shaft 136 serves as the secondary winding and is electrically connected with receiving elements which are not here shown in greater detail but which, for instance, can be constituted by photo-transistors, as previously explained, which act as switches and complete a circuit when struck by a firing or shooting pulse.

FIGS. 10 to 13 illustrate a particularly advantageous target apparatus for simulated shooting with a weapon which emits shooting pulses. This target apparatus here also contains a substantially disk-shaped revolving element 142 which has printed thereon target rings $14_1$ to $14_{10}$. Moreover, the revolving element 142 comprises a receiver 144 of the first detection device for target rings which have been hit. This receiver 144 contains light-conductors $146_1$ to $146_{10}$ which end or terminate along a radial ray of the target in the target plane and are connected with transmitter devices $148_1$ to $148_{10}$ which pass the light signal to stationary receiver elements $150_1$ to $150_{10}$, for instance in the form of photo-transistors. For this purpose, the disk-shaped revolving element 142 is located on a hollow shaft 152 in which the light conductors $146_1$ to $146_{10}$ are guided to the transmitter devices $148_1$ to $148_{10}$. The transmitter devices $148_1$ to $148_{10}$ each consist of a substantially annular or ring-shaped space 154 which is formed, on the one hand, by an annular or ring-shaped groove 156 provided in the hollow shaft 152 and having a groove base or bottom 158 of substantially arcuate cross-section and, on the other hand, by an inner surface 160 of a bearing 162. The walls of the annular space 154 are designed to be reflecting and, preferably, they are chromium-plated. The light signal introduced into the annular space 154 via a light-conductor $146_1$ to $146_{10}$ is passed on by reflection to the stationary receiving elements $150_1$ to $150_{10}$, respectively, and thus insures for reliable transmission to the receiving element even if the end of the light-conductor assumes a position which is offset by 180° relative to the receiving element. The walls of the annular grooves 156 and the hollow shaft 152 are extended up to the inner surface 160 of the bearing 162 in order to prevent an exchange of light signals between adjacent annular spaces. If desired, there can be provided an additional seal or gasket (not shown) in order to further improve the mutual screening of the annular spaces. Advantageously, the receiving elements $150_1$ to $150_{10}$ each contain a forwardly arranged collecting lens 164, by means of which there can be improved the detection of the light signal reflected in the annular space 154.

The target apparatus is provided with a second detection device in order to detect target sectors which have been hit. This second detection device likewise comprises a revolving receiver 166 containing light-conductors $168_1$ to $168_{10}$ which end along the radial ray of the first receiver 144. These end or open, similar to the first light-conductors $146_1$ to $146_{10}$, in the target plane of the revolving element 142. The ends of the light-conductors $146_1$ to $146_{10}$ and $168_1$ to $168_{10}$ are arranged in pairs and are situated as closely as possible to one another. The light-conductor pairs can be arranged next to one another either in the peripheral direction or in the direction of the radial ray. The light-conductors $168_1$ to $168_{10}$ extend in the revolving element 142 to a second transmitter device 170 where they are combined into a bundle 172. The bundle 172 successively coacts with stationary receiving elements $174_1$ to $174_n$ which are arranged along a circle 176 on a stationary flange 178 or equivalent structure. The number n of the stationary receiving elements $174_1$ to $174_n$ depends upon the number of target sectors which are to be monitored. If a coarse division is then desired, then there are required a correspondingly fewer number of receiving elements than with a fine division which requires a correspondingly large number of receiving elements. What is however important is that the receiving elements $174_1$ to $174_n$ render possible continuous monitoring of the target sectors. In the case of a few receiving elements, these must be arranged close to the rotational axis 180, whereas in the case of many receiving elements there must be maintained a correspondingly larger distance from the rotational axis 180, in order to accommodate them on the stationary flange 184. The receiving range of the receiving elements $174_1$ to $174_n$ is enlarged by the provision of a forwardly situated collecting lens 182. The light signal of any desired light-conductor $168_1$ to $168_{10}$ suffices to activate a receiving element $174_1$ to $174_n$. In the illustrated exemplary embodiment, one pair of light-conductors $146_1$ to $146_{10}$, $168_1$ to $168_{10}$ of the two detection devices is provided for each target ring. To enlarge the monitoring range, it is possible to either provide further pairs of light-conductors in the intermediate zones or to equip the light-conductors with collecting lenses 184 placed forwardly thereof, as has been indicated in FIGS. 10 and 11. To eliminate the effect of extraneous light, there can be advantageously provided a not particularly shown but conventional interference filter which is arranged at the inlet of the light-conductors $146_1$ to $146_{10}$ and $168_1$ to $168_{10}$.

A drive motor 186 serves to drive the revolving element 142.

Evaluation of the light signals generated by the firing pulses can occur in the manner already described in conjunction with the above explained exemplary embodiments.

An essential advantage of the target apparatus described in conjunction with FIGS. 10 to 13 is that, similar to the exemplary embodiment of FIG. 6, there is possible contactless scanning of the light signals from the revolving element to a stationary part, without having to feed electrical energy into the revolving element. In contrast to the design of the target apparatus of FIG. 6, the arrangement of FIGS. 10 to 13 is simpler and is safer against the influence of extraneous light.

The receiver devices $150_1$ to $150_{10}$ are of basic importance and are also suitable for other fields of application in technology where light signals are to be transmitted between a rotary part and a stationary part.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A target apparatus for simulated firing with a weapon which emits shooting pulses and for use with a target having target rings and target sectors, comprising:

a first detection device for detecting target rings which have been hit;

a second detection device for detecting target sectors which have been hit;

an evaluation device;

a hit-indicator device;

said first and second detection devices being mutually connected with one another by means of said evaluation device and with said hit-indicator device;

said first detection device comprising at least one revolving receiver containing receiving elements for the target rings;

said first detection device scanning the target for firing pulses in a revolving radial zone by means of said at least one revolving receiver; and said second detection device being structured to detect the position of the revolving receiver when struck by a firing pulse.

2. The target apparatus as defined in claim 1, wherein:

said receiver has a period of revolution which corresponds essentially to the duration of the firing pulse.

3. The target apparatus as defined in claim 1, wherein:

the target has a target axis;

said receiving elements being arranged along said target axis;

said receiver comprising a mirror strip inclined at an angle of about 45° with respect to the target axis and rotating about said target axis in order to deflect firing pulses onto said receiving elements.

4. The target apparatus as defined in claim 1, further including:

a rotary revolving element;

said receiving elements being located on said rotary revolving element;

a stationary element; and a transmitter device arranged between said revolving element and said stationary element.

5. The target apparatus as defined in claim 4, wherein:

said revolving element comprises a substantially disk-shaped revolving element.

6. The target apparatus as defined in claim 4, wherein:

said transmitter device comprises a contactless transmitter device.

7. The target apparatus as defined in claim 4, wherein:

said revolving element contains a coding device for the signals to be transmitted.

8. The target apparatus as defined in claim 4, wherein:

said revolving element is provided with memory means for the signals to be transmitted and which memory means is cleared at the end of a revolution of said revolving element.

9. The target apparatus as defined in claim 4, wherein:

said transmitter device comprises:

at least one transmitter located on said revolving element; and at least one receiver located on said stationary element.

10. The target apparatus as defined in claim 4, wherein:

said transmitter device comprises:

at least one capacitor plate located on the revolving element and rotatable therewith; and a stationary capacitor plate operatively associated with said at least one rotatable capacitor plate.

11. The target apparatus as defined in claim 4, wherein:

said transmitter device comprises:

at least one coaxially arranged induction coil which rotates with said revolving element; and a stationary induction coil coaxially arranged with respect to said induction coil which rotates with said revolving element and cooperating with said rotatable induction coil.

12. The target apparatus as defined in claim 4, wherein:

said transmitter device comprises:

at least one contact disk which rotates with the revolving element; and a stationary bath containing a conductive fluid into which emerses said rotating contact disk.

13. The target apparatus as defined in claim 12, wherein:

said conductive fluid is mercury.

14. The target apparatus as defined in claim 4, wherein:

said second detection device is located on said revolving element;

said second detection device comprising:

a number of transmitters for sector signals, corresponding to the number of target sectors to be detected;

a stationary receiver;

a counter with which there is connected said stationary receiver; and said counter being reset at the end of each revolution of the revolving element and wherein a ring signal interrupts counting.

15. The target apparatus as defined in claim 14, wherein:

said counter comprises a shift register.

16. The target apparatus as defined in claim 4, wherein:

said second detection device comprises a transmitter which is located on said revolving element;

a number of stationary receivers corresponding to the number and position of the target sectors to be covered; and said transmitter successively coacting with said number of stationary receivers.

17. The target apparatus as defined in claim 4, further including:

a capacitor plate corresponding essentially in size to the size of a target sector to be detected located on said revolving element;

a number of stationary capacitor plates, corresponding to the number and position of the target sectors to be detected, with which successively coacts said capacitor plate located on said revolving element.

18. The target apparatus as defined in claim 4, further including:

dynamo means provided on said revolving element for supplying current.

19. The target apparatus as defined in claim 1, wherein:

said detection devices each comprise receivers containing light-conductors;

a revolving element;

a stationary part;

receiving elements located on said stationary part;

said receivers ending along a radial ray in the target plane of said revolving element and leading to transmitter devices; and said transmitter devices arranged between said rotary revolving element and said stationary part.

20. The target apparatus as defined in claim 19, wherein:

pairs of said light-conductors of said first and second detection devices end along a radial ray in the target plane of the revolving element.

21. The target apparatus as defined in claim 20, wherein:

said revolving element has a shaft;

a stationary receiving element;

said light-conductors of said first detection device ending at the transmitter devices radially on the circumference of said shaft of the revolving element in a reflecting annular space; and said stationary receiving element monitoring said annular space.

22. The target apparatus as defined in claim 21, wherein:

said annular space is chromium-plated.

23. The target apparatus as defined in claim 21, further including:

a collecting lens arranged forwardly of said stationary receiving element.

24. The target apparatus as defined in claim 21, wherein:

said annular spaces being formed by annular groove means provided in said shaft.

25. The target apparatus as defined in claim 24, wherein:

said annular groove means includes a groove base of substantially arcuate cross-section.

26. The target apparatus as defined in claim 20, wherein:

said light-conductors of said second detection device are combined at said transmitter device for forming a bundle; and stationary receiving elements arranged along a circle and with which coacts in succession said bundle.

27. The target apparatus as defined in claim 26, further including:

a collecting lens placed forwardly of said stationary receiving elements.

28. The target apparatus as defined in claim 19, further including:

interference filter means for eliminating the influence of extraneous light located at the ends of the light-conductors.

29. The target apparatus as defined in claim 28, wherein:

said interference filter means is located in the plane of the target image.

30. The target apparatus as defined in claim 19, further including:

a collecting lens provided at the end of each of the light-conductors in the target plane of the revolving element.

* * * * *